US009273681B2

(12) United States Patent
Joffroy

(10) Patent No.: US 9,273,681 B2
(45) Date of Patent: Mar. 1, 2016

(54) GASEOUS FLUID COMPRESSION DEVICE

(75) Inventor: Jean-Marc Joffroy, Cabanes (FR)

(73) Assignee: BOOSTHEAT, Nîmes (FR)

( * ) Notice: Subject to any disclaimer, the term of this patent is extended or adjusted under 35 U.S.C. 154(b) by 380 days.

(21) Appl. No.: 13/984,485

(22) PCT Filed: Feb. 8, 2012

(86) PCT No.: PCT/EP2012/052114

§ 371 (c)(1),
(2), (4) Date: Aug. 8, 2013

(87) PCT Pub. No.: WO2012/107480

PCT Pub. Date: Aug. 16, 2012

(65) Prior Publication Data

US 2013/0323102 A1 Dec. 5, 2013

(30) Foreign Application Priority Data

Feb. 10, 2011 (FR) ..... 11 51098

(51) Int. Cl.

| | |
|---|---|
| ***F04B 23/00*** | (2006.01) |
| ***F04B 37/00*** | (2006.01) |
| ***F04B 25/00*** | (2006.01) |
| ***F04B 35/00*** | (2006.01) |
| ***F25B 9/00*** | (2006.01) |
| ***F04B 19/00*** | (2006.01) |

(52) U.S. Cl.

CPC ..... *F04B 37/00* (2013.01); *F04B 19/00* (2013.01); *F04B 25/00* (2013.01); *F04B 35/00* (2013.01); *F25B 9/00* (2013.01)

(58) Field of Classification Search

CPC ..... F04B 19/00; F04B 25/00; F04B 35/00; F04B 37/00; F25B 9/00; F25B 35/00; F25B 2400/072

USPC ..... 417/16, 313, 243; 62/610

See application file for complete search history.

(56) References Cited

U.S. PATENT DOCUMENTS

| | | | | | |
|---|---|---|---|---|---|
| 2,157,229 | A | | 5/1939 | Bush | |
| 3,165,172 | A | * | 1/1965 | Baker | F02G 1/04 123/196 AB |
| 3,413,815 | A | * | 12/1968 | Granryd | F02G 1/043 417/52 |
| 3,921,400 | A | * | 11/1975 | Pitcher | F02G 1/0445 307/155 |
| 4,139,991 | A | * | 2/1979 | Barats | F25B 9/00 62/403 |

(Continued)

FOREIGN PATENT DOCUMENTS

| | | | |
|---|---|---|---|
| DE | 102011118042 | A2 * | 5/2013 |
| EP | 0101565 | A1 | 2/1984 |
| JP | 2010-71481 | A | 4/2010 |

*Primary Examiner* — Charles Freay

(74) *Attorney, Agent, or Firm* — Seed IP Law Group PLLC

(57) ABSTRACT

A gaseous fluid compression device includes: a first enclosure within which there is a movable first piston delimiting a first chamber and a second chamber; a second enclosure within which there is a movable second piston delimiting a third chamber and a fourth; a first exchange circuit connecting the first chamber and the fourth chamber, with a heat exchanger linked to a heat sink; a second exchange circuit connecting the second chamber and the third chamber, with a second heat exchanger linked to a heat source; and a transfer passage connecting the first chamber and the second chamber with an anti-backflow device. A back-and-forth movement of the interconnected pistons results in a compression of the gaseous fluid in the direction of the outlet.

12 Claims, 4 Drawing Sheets

(56) References Cited

Figure 1:
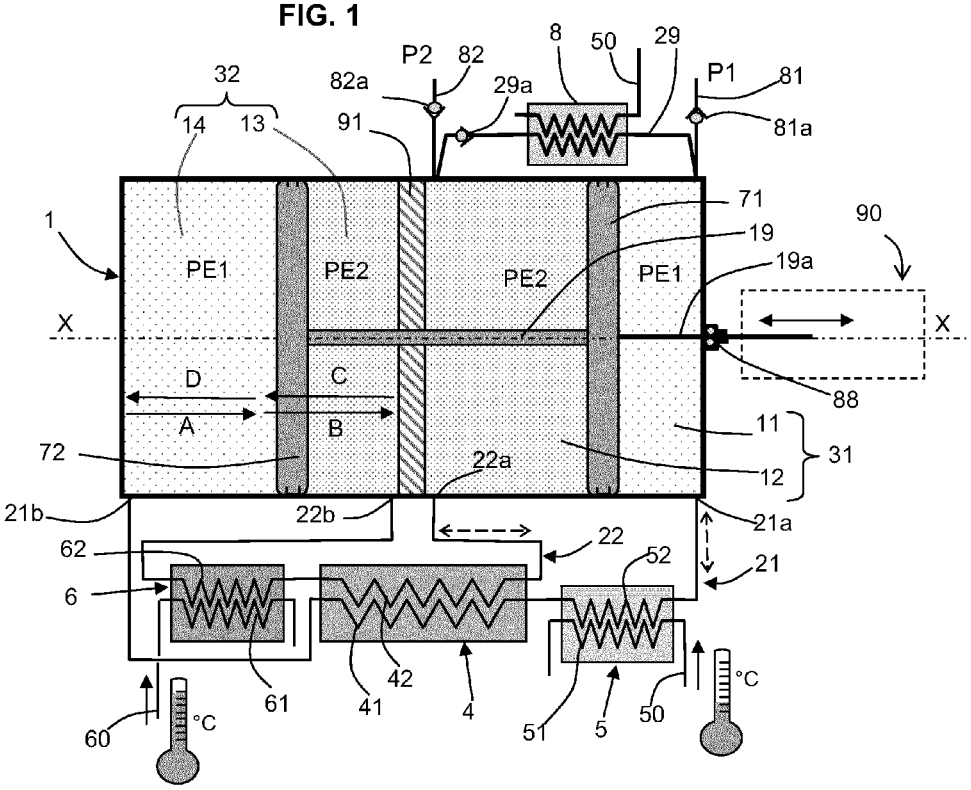

U.S. PATENT DOCUMENTS 4,390,322 A * 6/1983 Budzich ..... F04B 9/115
417/243
7,013,640 B2 * 3/2006 Gregory ..... F02G 1/0535
60/517
2007/0193290 A1 * 8/2007 Ebara ..... B60H 1/00885
62/238.6
2010/0212311 A1 8/2010 McQuary et al.
2010/0326075 A1 * 12/2010 Fong ..... F01K 25/06
60/650

* cited by examiner

GASEOUS FLUID COMPRESSION DEVICE

The invention relates to devices for compressing gaseous fluid, and particularly concerns regenerative thermal compressors.

CONTEXT AND PRIOR ART

There are several technical solutions already in existence for compressing a gas from a heat source.

First there are devices based on coupling a heat engine and a conventional compressor. These solutions use a heat engine (generally an internal combustion engine) to convert the heat into mechanical or electrical energy (via a generator), and then transfer this energy to a compressor either directly through a mechanical transmission system, or indirectly through a motor. These solutions are complex and generate pollution, and require significant maintenance.

There also exist solutions specific to certain fluids (thermochemical processes) usable only in specific contexts, such as ammonia compression systems used in refrigeration cycles (absorption heat pumps or refrigerators). The disadvantages of absorption heat pumps are the limited thermodynamic efficiency and the safety issues posed by a harmful and flammable fluid, rendering them of very limited interest for residential heating.

There also devices called thermal compressors. A thermal compressor is a device which performs cycles of intake, compression, discharge, and expansion of a gas (conventional cycle of a mechanical reciprocating compressor for example), not from a mechanical source via a coupling to an external engine but directly from a source of heat transmitted by an integrated exchanger.

In these thermal compressors, such as those described in U.S. Pat. Nos. 2,157,229 and 3,413,815, the heat received is directly transmitted to the fluid to be compressed, which eliminates the need for any mechanical element in the compression and discharge steps.

In a thermal compressor, a mechanical means such as a moving piston causes a portion of the fluid to be compressed to pass, during different steps of the cycle, through different heat exchangers delimiting a cold zone and a hot zone. The variations in pressure are caused by the heat exchanges at an essentially constant volume.

These devices are also characterized by the presence of a regenerative heat exchanger through which a portion of the fluid flows, in one direction and then the other, during different steps in the cycle. These regenerative heat exchanger technologies remain underdeveloped and costly, and generate a significant pressure drop.

These devices are designed as single-stage systems, with the level of compression being limited. For certain compression applications, it would be necessary to multiply the number of single-stage compressors by placing three or four in a series arrangement, and to institute a mechanism for mechanically synchronizing the various stages. Such an implementation would be costly and complex, and the mechanical losses would be increased by the proliferation of the mechanical devices. There is also the risk of leakage resulting from the presence of the synchronization mechanism.

In addition, these systems are not self-driven. The movement of the displacement element must be controlled by an external mechanical system which ensures the back and forth movement of the piston. This implies additional complexity and the same leakage issue as with open mechanical compressors.

SUMMARY OF THE INVENTION

The purpose of the invention is to provide improvements to the prior art by resolving some or all of the disadvantages mentioned above.

The invention therefore proposes a gaseous fluid compression device comprising:

- a first enclosure,
- an inlet for the gaseous fluid to be compressed,
- a first piston assembled to be movable within the first enclosure and delimiting in a fluid-tight manner a first chamber and a second chamber inside said first enclosure,
- an outlet for the compressed gaseous fluid connected to said second chamber, the inlet being connected to said first chamber,
- a second enclosure,
- a second piston assembled to be movable within the second enclosure and delimiting in a fluid-tight manner a third chamber and a fourth chamber inside said second enclosure,
- a first exchange circuit establishing a communication of fluid between the first chamber and the fourth chamber, having a first heat exchanger to convey heat to a heat sink,
- a second exchange circuit establishing a communication of fluid between the second chamber and the third chamber, having a second heat exchanger to convey heat from a heat source,
- a transfer passage establishing a communication of fluid from the first chamber to the second chamber, with an interposed anti-backflow device, and wherein the first and second pistons are connected by a mechanical connection element, by means of which a back-and-forth movement of the pistons results in a compression of the gaseous fluid in the direction of the outlet.

By virtue of these arrangements, two compression stages are combined in a simple manner by the mechanical connection of the pistons and the communication of fluid between chambers; the resulting level of compression may be appropriate for certain heat transfer fluid circuits.

In various embodiments of the invention, one or more of the following arrangements may be used.

In one aspect of the invention, the first and second enclosures are formed inside a closed cylinder having a primary axis, with said first and second enclosures being axially arranged one after the other; and the mechanical connection element is a rod rigidly connecting the first and second pistons, with said pistons being movable along the primary axis. This is a particularly compact and simple solution for integrating two compression stages into one unit.

In another aspect of the invention, the first exchange circuit and the second exchange circuit both additionally pass through a two-stream countercurrent heat exchanger such that the gaseous fluids travel in countercurrent flows when the first and second pistons move. It is thus possible to use a standard heat exchanger for the regenerative function, which greatly simplifies the design of the regenerative function over the prior art.

In another aspect of the invention, the second heat exchanger comprises an intake circuit and an output circuit which both pass through an economizing heat exchanger with countercurrent flows. This optimizes the effectiveness of the heat transfer from the heat source.

In another aspect of the invention, the transfer passage is cooled by an auxiliary cooling circuit. This lowers the temperature of the gas when it exits the first compression stage, in order to obtain a moderate temperature when entering the second compression stage.

In another aspect of the invention, the transfer passage is arranged within the first piston as an opening with a check valve. This eliminates the need for external pipes connecting the first and second chambers.

In another aspect of the invention, the compression device additionally comprises a drive system for driving the pistons which comprises an auxiliary chamber, an auxiliary piston hermetically separating the first chamber from the auxiliary chamber, a flywheel, a connecting rod connecting said flywheel to the auxiliary piston, the auxiliary piston being mechanically connected to the first and second pistons, by means of which the back-and-forth movement of the pistons can be self-maintained by said drive system. The self-driving system is housed inside the enclosure and no moving element passes through the casing, which eliminates the need for any rotating joint or slip joint to ensure a fluid-tight seal for an external driving system as in the prior art.

In another aspect of the invention, the compression device additionally comprises an electric motor coupled to the flywheel, said motor being configured to impart an initial rotational motion to the motor flywheel so that the autonomous driving is initialized.

In another aspect of the invention, the motor can be controlled in generator mode by a control unit, by means of which the motor flywheel can be slowed and the rotational speed of the motor flywheel can be regulated.

In another aspect of the invention, the device additionally comprises a second cylinder arranged at the end of the closed cylinder, with said second cylinder including:

- a third enclosure,
- a third piston assembled to be movable within the third enclosure and delimiting in a fluid-tight manner a fifth chamber and a sixth chamber inside said third enclosure,
- a fourth enclosure,
- a fourth piston assembled to be movable within the fourth enclosure and delimiting in a fluid-tight manner a seventh chamber and an eighth chamber inside said fourth enclosure,
- a third exchange circuit establishing a communication of fluid between the fifth chamber and the eighth chamber, having a third heat exchanger to convey heat to a heat sink,
- a fourth exchange circuit establishing a communication of fluid between the sixth chamber and the seventh chamber, having a fourth heat exchanger to convey heat from a heat source,
- a second transfer passage establishing a communication of fluid between the fifth chamber and the sixth chamber, with an interposed anti-backflow device, wherein the third and fourth pistons are attached to the rod, and wherein the outlet from the second chamber is connected to the fifth chamber. Thus four stages can be integrated in a simple manner within one unit.

In another aspect of the invention, the inside cross-section of the third and fourth enclosures is smaller than the inside cross-section of the first and second enclosures. This accommodates the fact that the stroke traveled by all the pistons is the same but the pressure is greater in the higher compression stages and the gaseous fluid occupies a smaller volume.

Lastly, the invention also relates to a thermal system comprising a heat transfer circuit and a compressor according to any one of the above aspects. The thermal system in question may be intended for removing heat from a enclosed space, in which case it is an air-conditioning or refrigeration system, or the thermal system in question may be intended for bringing heat to an enclosed space, in which case it is a heating system such as a system for residential or industrial heating.

Figure 2:
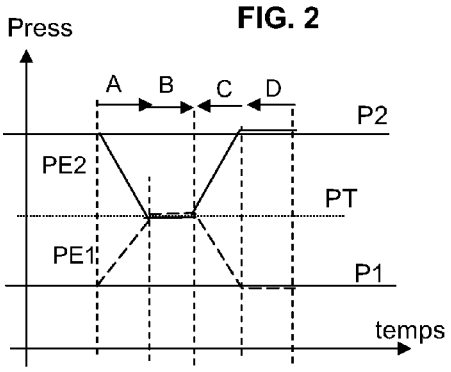
Figure 3:
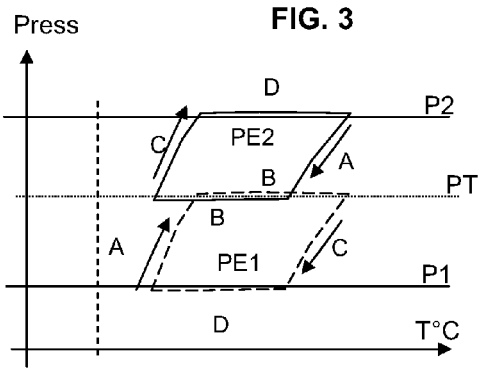
Figure 4:
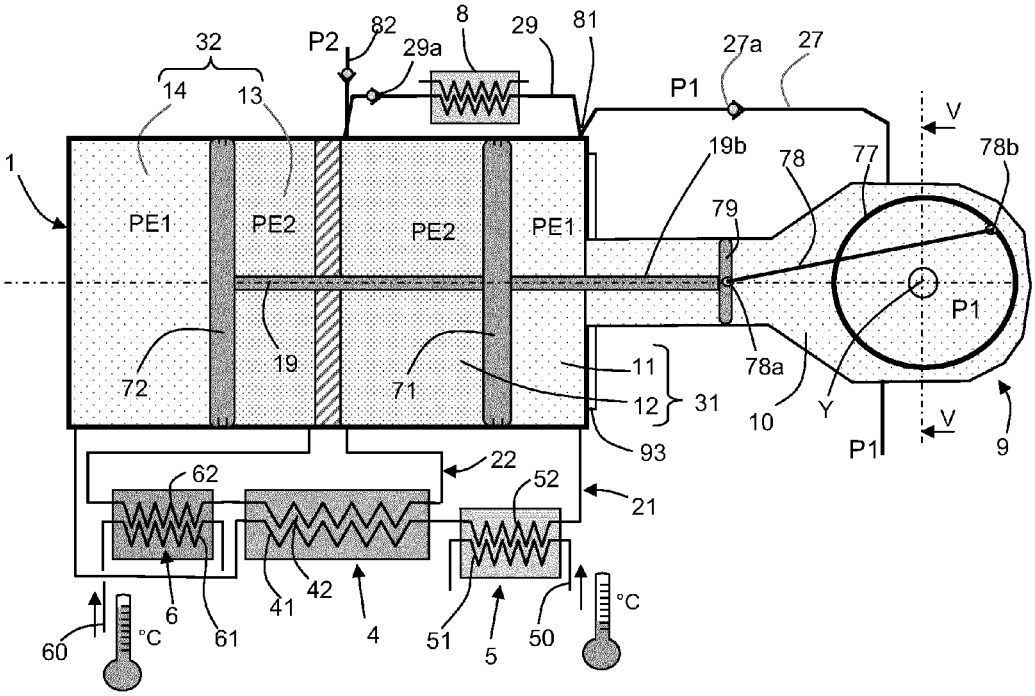
Figure 5:
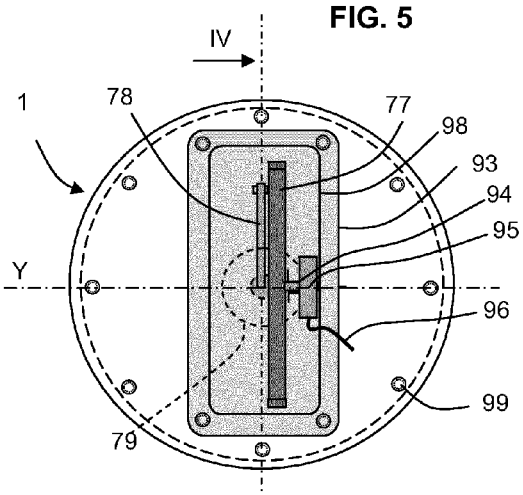
Figure 6:
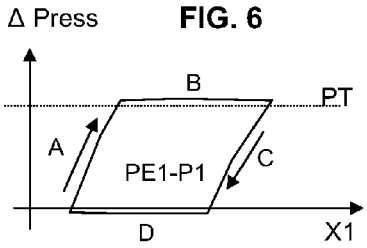
Figure 7:
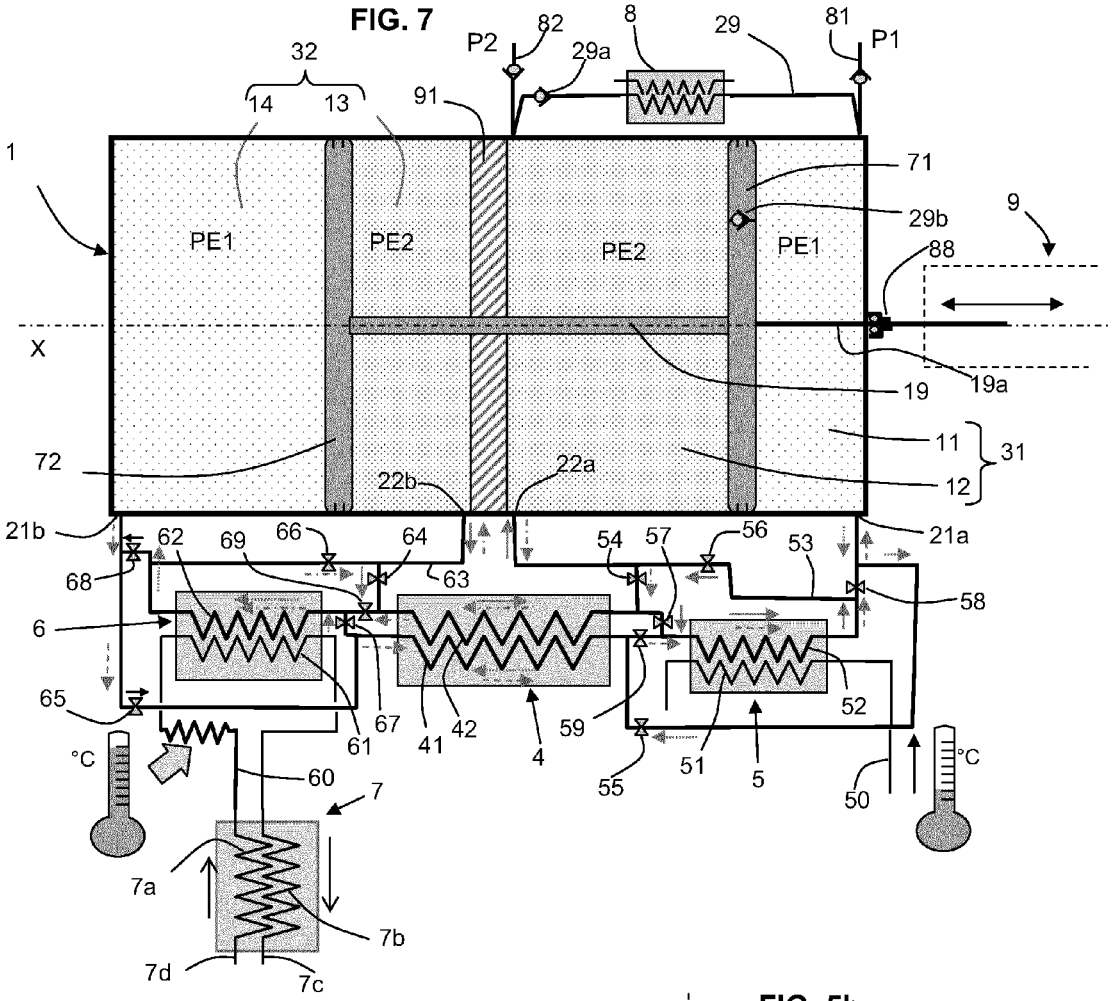
Figure 5B:
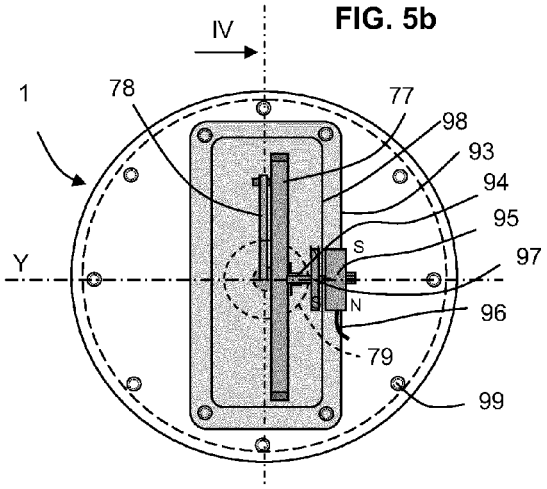
Figure 8:
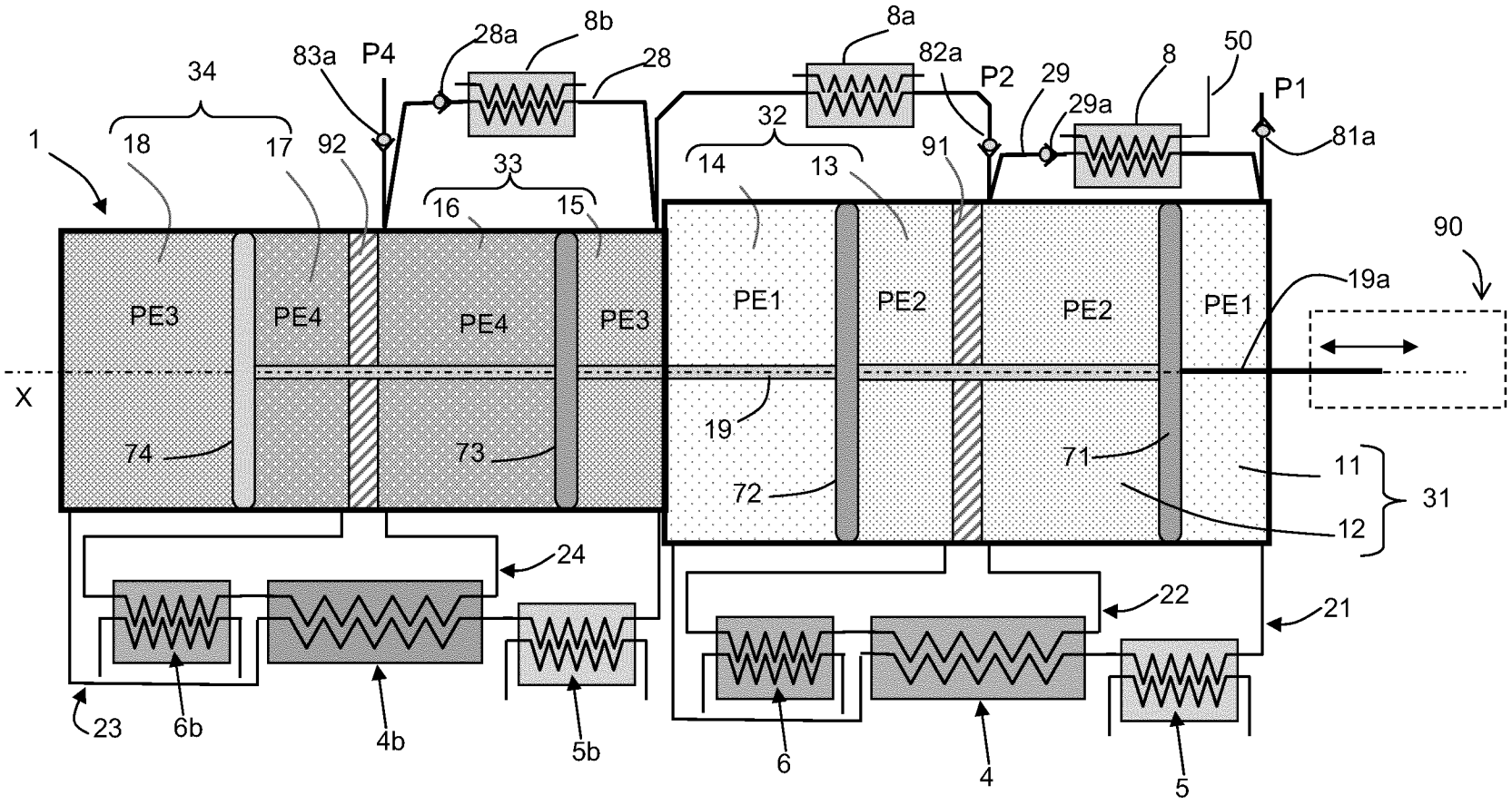

Other features and advantages of the invention will be apparent from reading the following description of two of its embodiments provided as non-limiting examples. The invention will also be better understood by considering the attached drawings, in which:

FIG. 1 is a schematic view of a gaseous fluid compression device according to the invention, FIG. 2 represents a pressure-time diagram of the cycle implemented by the compression device of FIG. 1, FIG. 3 represents a pressure-temperature diagram for the cycle implemented by the compression device of FIG. 1, FIG. 4 is a view analogous to the one in FIG. 1, but additionally shows the self-driving system, FIGS. 5 and 5*b* show the device of FIG. 4, viewed from the end in the plane V-V in FIG. 4, with FIG. 5*b* representing an alternative solution to the one in FIG. 5, FIG. 6 represents a diagram of the cycle carried out by the self-driving device, FIG. 7 represents the compression device of FIG. 1 with a few variants, and FIG. 8 shows a second embodiment of the compression device with four compression stages.

The same references in the different figures indicate the same or similar elements.

FIG. 1 shows a gaseous fluid compression device of the invention, adapted to admit a gaseous fluid by an intake or inlet 81, at a pressure P1, and to provide the compressed fluid at an outlet 82 at a pressure P2 which is greater than P1. The inlet 81 can be fitted with a valve 81*a* (or 'check valve' 81*a*), while the outlet can be fitted with a valve 82*a* ('check valve' 82*a*). These two check valves are not necessarily in proximity to the compression device.

In the illustrated example, the compression device comprises a cylindrical casing 1 which contains two enclosures 31,32 that are cylindrical in form, have the same cross-section, are coaxial to a primary axis X, and are separated by a hermetic wall 91. A first piston 71 is assembled to be movable inside the first enclosure 31, and thus delimits a first chamber 11 and a second chamber 12 inside the first enclosure 31. Similarly, a second piston 72 is assembled to be movable inside the second enclosure 32, and thus delimits a third chamber 13 and a fourth chamber 14 inside the second enclosure 32.

The pistons 71,72 are in the form of disks having a piston ring along their circumference to hermetically isolate the chambers that they separate.

A mechanical connection element, in the form of a rod having a small cross-section in the illustrated example, mechanically connects the first and second pistons 71,72 by passing through the wall 91. The two pistons 71,72 move with the rod 19 in parallel to the direction of the primary axis X. At the location where the rod 19 passes through the wall 91, it is not necessary to be concerned about the seal because the pressure differential is zero as will be seen below.

An auxiliary rod 19*a* can also connect the first piston 79 with an external device 90 that drives the piston train as will be discussed below.

As illustrated in FIG. 1, the device additionally comprises:

a first exchange circuit 21 establishing a continuous communication of fluid between the first chamber 11 and the fourth chamber 14, having a first heat exchanger 5 for conveying heat to a heat sink 50, a second exchange circuit 22 establishing a continuous communication of fluid between the second chamber 12 and the third chamber 13, having a second heat exchanger 6 for conveying heat from a heat source 60, a transfer passage 29 establishing a communication of fluid between the first chamber and the second chamber, with an interposed anti-backflow device 29*a*, such that the gaseous fluid can flow from the first chamber 11 to the second chamber 12 and not the reverse.

In the illustrated example, the first exchange circuit 21 and the second exchange circuit 22 pass through a two-stream countercurrent heat exchanger 4, also called a regenerative heat exchanger; this regenerative heat exchanger 4 comprises two pipes 41,42 in which the gas flows are countercurrent during the movement of the pistons.

The first exchange circuit 21 runs from an end 21*a* connected to the first chamber 11, then through a pipe 52 of the first exchanger 5, then through one of the pipes 41 of the two-stream exchanger 6 to rejoin the fourth chamber 14 at its other end 21*b*.

The second exchange circuit 22 runs from an end 22*a* connected to the second chamber 12, then through the other pipe 42 of the two-stream exchanger 4, then through a pipe 62 of the second exchanger 6 to rejoin the third chamber 13 at its other end 22*b*.

In the second heat exchanger 6, a heat contributing fluid, independent of the gaseous fluid to be compressed, travels through an exchange pipe 61 thermally coupled to the pipe 62 already mentioned. In the first heat exchanger 5, a cold contributing fluid, also independent of the gaseous fluid to be compressed, travels through an exchange pipe 51 thermally coupled to the pipe 52 already mentioned.

It should be noted that the first chamber 11, the fourth chamber 14, and the first exchange circuit 21 are substantially at the same pressure, denoted PE1, which changes over time under the effect of the variations in temperature as will be detailed below. It should also be noted that the sum of the volumes of the first chamber 11 and the fourth chamber 14 remain substantially constant when the pistons 71,72 move. The first chamber 11, the fourth chamber 14, and the first exchange circuit 21 constitute the first compression stage.

Similarly, the second chamber 12, the third chamber 13, and the second exchange circuit 22 are substantially at the same pressure, denoted PE2, which changes over time under the effect of variations in temperature as will be specified below. Similarly, the sum of the volumes of the second chamber 12 and the third chamber 13 remain substantially constant when the pistons 71,72 move. The second chamber 12, the third chamber 13, and the second exchange circuit 22 constitute the second compression stage.

Advantageously in the invention, the sum of the pressures exerted on the piston train is balanced; in effect, the pressure differential PE2-PE1 on the first piston 71 is compensated for by the pressure differential PE1-PE2 on the second piston 72, keeping in mind that the effect of the rod cross-section is negligible.

Advantageously in the invention, the first enclosure 31 (chambers 11,12) contains cold gas and the second enclosure 32 (chambers 13,14) contains hot gas. The wall 91 separating the two enclosures is of thermally insulating material, for example steel or a high performance polymer. Similarly, the outer casing 1, preferably made of stainless steel, inconel or high performance polymer, preferably has a relatively low thermal conductivity, for example less than 50 W/m/K. Similarly, the rod 19, preferably of a steel or high performance polymer material, preferably has a relatively low thermal conductivity, for example less than 50 W/m/K.

The operation will be further detailed below.

The operation of the compressor is assured by the alternating movement of the train of pistons 71,72, as well as by the action of the intake valve 81*a* at the inlet, the check valve 82*a* for the discharge at the outlet, and the check valve 29*a* for the transfer in the transfer passage 29.

The cycle operation is described below, with the changes in pressure represented in FIGS. 2 and 3.

The longitudinal profile of the temperatures within the first and second exchangers (5,6) is substantially constant. In an exemplary implementation of the invention, in the first exchanger 5 (for cooling) the temperature stabilizes around 50° C., while in the second exchanger 6 (for heating) the temperature stabilizes around 650° C.

The different steps A,B,C,D, described below are represented in FIGS. 1, 2 and 3.

Step A.

The pistons, initially on the left in FIG. 1, move towards the right. The various valves are closed. As we will see, the pressures at this time are PE1=P1 in the first stage and PE2=P2 in the second stage. In the first stage, gas passes from the first chamber 11 (cold part) to the fourth chamber 14 by traveling (via first exchange circuit 21) through the first exchanger 5 then the two-stream exchanger 4, and changes from a temperature of about 50° C. to 650° C. The pressure PE1 rises from heating at a substantially constant volume. At the same time in the second stage, gas passes (via second exchange circuit 22) from the third chamber 13 where it is at a temperature of about 650° C. to the second chamber 12 by traveling through the second exchanger 6 then the two-stream exchanger 4. The pressure PE2 falls by cooling at a substantially constant volume. This process continues until the pressure PE1 is slightly greater than PE2, such that the transfer check valve 29*a* (also called the intermediate discharge valve) opens.

The pistons are then in an intermediate position, represented by the end of the arrow A for the left piston in FIG. 1.

Step B

As the transfer check valve 29*a* is open, the subsequent rightward movement of the pistons 71,72 causes a backflow from the first stage towards the second stage. During this step, the pressures PE1 and PE2 remain substantially equal, at an intermediate level denoted PT in FIGS. 2 and 3. This step continues until the end of the rightward travel of the pistons.

Step C

The pistons now move towards the left. In the first stage, the hot gas passes from the fourth chamber 14 to the first chamber 11, traveling (via first exchange circuit 21) through the pipe 41 of the two-stream exchanger 4 and through the first exchanger 5, which cools the gas. The pressure PE1 falls. Conversely in the second stage, the gas passes from the second chamber 12 to the third chamber 13, traveling (via second exchange circuit 22) through the pipe 42 of the two-stream exchanger 4 countercurrent to the pipe 41, and through the second exchanger 6, which reheats the gas and the pressure PE2 rises. The intermediate discharge valve 29*a* therefore closes at the start of this step.

This process continues until the pressure PE1 falls slightly below P1 and the pressure PE2 slightly exceeds P2.

The intake valves 81*a* and discharge valves 82*a* open at that time. The pistons are then in an intermediate position, represented by the end of the arrow C for the left piston in FIG. 1.

Step D.

During the end of the leftward travel of the pistons, the first stage suctions gas through the intake valve 81*a* at a pressure assumed to be constant P1 (if the tank upstream is of sufficient size), while the second stage discharges gas through the discharge valve 82*a* at a pressure assumed to be constant P2 (if the tank downstream is of sufficient size). This step continues until the end of the leftward travel of the pistons.

As shown in FIG. 1, the piston train is driven by a system 90 outside the casing 1, and there is a gasket 88 which presses on the rod 19.

It is preferred in the invention if the use of any gasket or seal of this type is avoided. FIGS. 4, 5, 5*b* and 6 describe the piston drive system 9 integrated inside the casing, comprising an auxiliary chamber 10, with an auxiliary piston 79 hermetically separating the first chamber 11 from the auxiliary chamber 10. Said system also comprises a flywheel 77, with a connecting rod 78 connecting said wheel to the auxiliary piston 79. Said connecting rod has a first end 78*a* attached by a pivoting connection to the auxiliary piston, and a second end 78*b* attached by a pivoting connection to the flywheel. The auxiliary piston 79 is mechanically connected to the first and second pistons (71,72) by the auxiliary rod 19*b*.

Advantageously according to the invention, the intake of gas passes through the auxiliary chamber 10 which is at pressure P1. Thus pressure P1 prevails to the right of the auxiliary piston 79, while pressure PE1 prevails to the left of the auxiliary piston 79. As illustrated in FIG. 6, the forces exerted on the piston train supply energy to the flywheel during steps A, B and D, while in step C it is the flywheel which supplies energy to the piston train, keeping in mind that the piston train must at all times overcome the frictional forces from the piston rings. As a result, the back-and-forth movement of the pistons can be self-maintained by said drive system.

The rotational speed of the motor flywheel and therefore the frequency of the piston strokes is established when the power expended in friction reaches the power delivered to the auxiliary piston by the thermodynamic cycle.

As illustrated in FIG. 5, a housing 98 enclosing the auxiliary chamber 10 has a base 93 which is attached to the cylinder 1 by conventional attachment means 99. In addition, the drive system 9 may comprise an electric motor 95 which is coupled to the motor flywheel 77 through a shaft 94 centered on axis Y. In the example represented in FIG. 5, the motor 95 is inside the housing 98, and therefore inside the enclosure where the gas is confined at the intake pressure P1. Only the wiring 96 supplying power to the motor passes through the wall of the housing, but without any relative movement which makes it possible to have a high efficiency seal.

In the variant represented in FIG. 5*b*, the motor is of a particular form having a rotor disc 97, for example a permanent magnet type, which is positioned inside the enclosure against the wall, and a stator positioned outside the enclosure against the wall. In this case, the electromagnetic control circuits and the wiring 96 are external.

It is understood, however, that the motor could be external, completely outside the housing 98, but in this case a rotating seal is necessary around the shaft.

In addition, said electric motor 95 coupled to the flywheel is adapted to impart an initial rotational movement to the motor flywheel to initialize the autonomous driving. In addition, the motor can be controlled in generator mode by a control unit (not represented), by means of which the motor flywheel can be slowed and the rotational speed of the motor flywheel can be regulated.

During normal operation, the mechanical power supplied to the self-driving device 9 will be greater than the losses due to friction, so that residual electrical power is available (normal mode of operation as generator). This supplemental electrical power will be usable by the electrical devices outside the compressor, including its regulating system, to drive the pumps or fans of a refrigeration cycle, to recharge a starting battery, or for cogeneration needs.

As represented in FIG. 7, certain variants may be used individually or in combination with the characteristics already described.

An auxiliary cooling circuit 8 allows cooling the transfer passage 29, which lowers the temperature of the gas as it exits from the first compression stage in order to obtain a moderate temperate at the entrance to the second compression stage. The fluid supplied to this auxiliary cooler 8 to act as the heat sink can be the same as the fluid traveling through the pipe 51 of the first exchanger 5. In an application involving residential or industrial heating, the fluid used as the heat sink 50 can be the fluid of the general heating circuit.

Alternatively to an external transfer passage 29, it is also possible to use an internal transfer passage 29*b* which is implemented as a check valve 29*b* inside the first piston 71.

An economizing heat exchanger 7 connected to the second exchanger 6 comprises an inlet 7*d*, a supply circuit 7*a* thermally coupled to a return circuit 7*b*, and an outlet 7*c*. The heat contributing fluid is independent of the gaseous fluid to be compressed, and travels out and back in opposite directions through this countercurrent economizing heat exchanger. The contribution of heat 60 is made between the supply circuit 7*a* and the pipe 61 of the second exchanger 6. The return circuit 7*b* conveys heat to the supply circuit 7*a* which optimizes the efficiency of the heat contribution from the heat source 60.

Another variant consists of adding auxiliary portions 53,63 to the first and second exchange circuits to allow selectively directing the heat exchange flows through the first and second exchangers 5,6. More specifically, a series of twelve solenoid valves (55 to 59 and 65 to 69) are added to the exchange circuits.

As represented in FIG. 7, when the pistons move from left to right, the solenoid valves 54,58,59,65,66,69 are set to the closed state, while the solenoid valves 55,56,57,64,67,68 are set to the open state. The flow exiting the first chamber 11 does not pass through the first heat exchanger 5: it passes through the solenoid valve 55 and thus bypasses the first exchanger 5, then it enters the pipe 41 of the exchanger 4 and passes into the second exchanger 6 via the valves 67 and 68, said flow being represented by the dotted arrows. Similarly, the flow exiting the third chamber 13 does not pass through the second heat exchanger 6: it passes through the solenoid valve 64, then it enters the pipe 42 of the exchanger 4 and passes into the first exchanger 5 via the valves 57 and 56, said flow being represented by the solid arrows.

On the other hand, when the pistons move from right to left, the solenoid valves 54,58,59,65,66,69 are set to the open state, while the solenoid valves 55,56,57,64,67,68 are set to the closed state. The flow leaving the second chamber 12 does not pass through the first heat exchanger 5: it passes through the solenoid valve 54, then it enters the pipe 42 of the exchanger 4 and passes into the second exchanger 6 via the valves 69 and 66, said flow being represented by the dotted and dashed arrows. Similarly, the flow exiting the fourth chamber 14 does not pass through the second heat exchanger 6: it passes through the solenoid valve 65 and thus bypasses the second exchanger 6, then it enters the pipe 41 of the exchanger 4 and passes into the first exchanger 5 via the valves 59 and 58, said flow being represented by the dashed arrows.

With these twelve solenoid valves added to the circuits and the appropriate controls, the heat flows can be improved and the heat exchangers 5 and 6 can be shared by the first and second stages.

A second embodiment, illustrated in FIG. 8, concerns a compressor with four stages constructed by duplicating the two-stage configuration illustrated in the first embodiment, and adding:

a third enclosure 33, a third piston 73 assembled to be movable within the third enclosure and delimiting in a fluid-tight manner a fifth chamber 15 and a sixth chamber 16 inside said third enclosure, a fourth enclosure 34, a fourth piston 74 assembled to be movable within the fourth enclosure and delimiting in a fluid-tight manner a seventh chamber 17 and an eighth chamber 18 inside said fourth enclosure, a third exchange circuit 23 establishing a communication of fluid between the fifth chamber and the eighth chamber, having a third heat exchanger 5*b* to convey heat to a heat sink, a fourth exchange circuit 24 establishing a communication of fluid between the sixth chamber and the seventh chamber, having a fourth heat exchanger 6*b* to convey heat from a heat source, a second transfer passage 28 establishing a communication of fluid between the fifth chamber 15 and the sixth chamber 16, with an interposed anti-backflow device 28*a*.

The third and fourth pistons are attached to the rod 19 which passes through a second wall 92 separating the third and fourth enclosures, similar to the first wall 91 already described, and passes also through the wall 95 separating chambers 14 and 15.

The outlet from the second stage, issuing from the second chamber, is connected to the inlet to the fifth chamber (intake of the third stage) via the check valve 82*a*. The transfer passages between each stage preferably pass through cooling circuits 8,8*a*,8*b* to avoid too much heating of the gaseous fluid. Preferably, in a heating application, the fluid used for cooling is the fluid of the general heating circuit.

As for the operation of the third and fourth stages, what was described for the first and second stages applies mutatis mutandis.

The outlet from the fourth stage delivers the compressed gas at pressure P4 through the valve 83*a*.

One should note that the described entities can have any form and dimensions while remaining within the scope of the invention, particularly the stroke/bore ratio, the form of the check valves, the arrangement of the first and second enclosures, etc.

According to advantageous embodiments of the invention, the gaseous fluid to be used can be chosen among HFC (hydrofluorocarbons) standard refrigerants like R410A, R407C, R744 or the like.

According to advantageous embodiments of the invention, the operating frequency of the piston train can be chosen in the range from 5 Hz to 10 Hz (300 to 600 Rpm).

According to advantageous embodiments of the invention, the compressor total displacement (sum of all chambers volume) can be chosen in the range from 0.2 liter to 0.5 liter for a heat pump application having a power comprised between 10 and 20 kW.

According to advantageous embodiments of the invention, the operating pressure of the gaseous fluid may vary from 40 bars to 120 bars.

The invention claimed is:

1. A gaseous fluid compression device, comprising:

an inlet for gaseous fluid to be compressed, a first enclosure, a first piston assembled to be movable within the first enclosure and delimiting in a fluid-tight manner a first chamber and a second chamber inside said first enclosure, an outlet for the compressed gaseous fluid connected to said second chamber, the inlet being connected to said first chamber, a second enclosure, a second piston assembled to be movable within the second enclosure and delimiting in a fluid-tight manner a third chamber and a fourth chamber inside said second enclosure, a first exchange circuit establishing a communication of fluid between the first chamber and the fourth chamber, having a first heat exchanger to convey heat to a heat sink, a second exchange circuit establishing a communication of fluid between the second chamber and the third chamber, having a second heat exchanger to convey heat from a heat source, a first transfer passage establishing a communication of fluid from the first chamber to the second chamber, with an interposed first anti-backflow device, and a mechanical connection element connecting the first and second pistons and enabling a back-and-forth movement of the pistons which results in a compression of the gaseous fluid toward the outlet.

2. The gaseous fluid compression device according to claim 1, wherein said first and second enclosures are formed inside a closed first cylinder having a primary axis, with said first and second enclosures being axially arranged one after the other, and wherein the mechanical connection element is a rod rigidly connecting the first and second pistons, with said pistons being movable along the primary axis.

3. The gaseous fluid compression device according to claim 1, comprising a two-stream countercurrent heat exchanger through which the first exchange circuit and the second exchange circuit both additionally pass, such that the gaseous fluids travel in countercurrent flows when the first and second pistons move.

4. The gaseous fluid compression device according to claim 1, wherein the second heat exchanger comprises an intake circuit and an output circuit which both pass through an economizing heat exchanger with countercurrent flows.

5. The gaseous fluid compression device according to claim 1, comprising an auxiliary cooling circuit configured to cool the first enclosure.

6. The gaseous fluid compression device according to claim 1, wherein the first transfer passage is arranged within the first piston as an opening with a check valve.

7. The gaseous fluid compression device according to claim 1, additionally comprising a drive system configured to maintain the back-and-forth movement of the pistons, the drive system including an auxiliary chamber, an auxiliary piston hermetically separating the first chamber from the auxiliary chamber, a flywheel, a connecting rod connecting said flywheel to the auxiliary piston, the auxiliary piston being mechanically connected to the first and second pistons.

8. The gaseous fluid compression device according to claim 7, additionally comprising an electric motor coupled to the flywheel, said motor imparting an initial rotational motion to the flywheel so that an autonomous driving of the first and second pistons by the drive system is initialized.

9. The gaseous fluid compression device according to claim 8, wherein the motor can be controlled in a generator mode by a control unit, by means of which the flywheel can be slowed and a rotational speed of the flywheel can be regulated.

10. The gaseous fluid compression device according to claim 2, additionally comprising a second cylinder arranged at an end of the closed first cylinder and on the main axis, with said second cylinder including:

a third enclosure, a third piston assembled to be movable within the third enclosure and delimiting in a fluid-tight manner a fifth chamber and a sixth chamber inside said third enclosure, a fourth enclosure, a fourth piston assembled to be movable within the fourth enclosure and delimiting in a fluid-tight manner a seventh chamber and an eighth chamber inside said fourth enclosure, a third exchange circuit establishing a communication of fluid between the fifth chamber and the eighth chamber, having a third heat exchanger to convey heat to a heat sink, a fourth exchange circuit establishing a communication of fluid between the sixth chamber and the seventh chamber, having a fourth heat exchanger to convey heat from a heat source, a second transfer passage establishing a communication of fluid between the fifth chamber and the sixth chamber, with an interposed second anti-backflow device, wherein the third and fourth pistons are attached to the rod, and wherein the outlet from the second chamber is connected to the fifth chamber.

11. The gaseous fluid compression device according to claim 10, wherein an inside cross-section of the third and fourth enclosures is smaller than an inside cross-section of the first and second enclosures.

12. A thermal system comprising a heat transfer circuit and the gaseous fluid compression device according to claim 1.

* * * * *